US005986276A

United States Patent [19]

Labriola, II

[11] Patent Number: 5,986,276

[45] Date of Patent: Nov. 16, 1999

[54] APPARATUS AND METHOD FOR ELIMINATING X-RAY HAZARDS FROM ELECTRICAL POWER DISTRIBUTION FIELDS

[76] Inventor: Donald P. Labriola, II, 727 Glenlea St., LaVerne, Calif. 91750

[21] Appl. No.: 08/697,820

[22] Filed: Aug. 30, 1996

Related U.S. Application Data

[63] Continuation-in-part of application No. 08/264,470, Jun. 23, 1994, abandoned.

[51] Int. Cl.[6] ..... G21F 1/12

[52] U.S. Cl. ..... 250/515.1

[58] Field of Search ..... 250/515.1, 505.1, 250/517.1, 519.1

[56] References Cited

U.S. PATENT DOCUMENTS 4,833,334 5/1989 Valy et al. ..... 250/515.1
4,837,448 6/1989 Sainte Luce Banchelin et al. ..... 250/515.1

*Primary Examiner*—Kiet T. Nguyen
*Attorney, Agent, or Firm*—Boniard I. Brown

[57] ABSTRACT

Health hazards to persons from prolonged exposure to high power fields, and specifically to X-ray radiation in such fields in the etiology of leukemia and other forms of cancer, are eliminated by preventive monitoring to detect corona indicating existence of ionization fields, and by coating cable and support structures with a material comprising low molecular number (Z) elements in carriers such as polymers in amorphous or molded forms to absorb energy and prevent X-ray formation. Shields of relatively high Z elements in polymer bases are provided to confine potential X-ray sources due to arcing at switch contacts.

18 Claims, 2 Drawing Sheets

APPARATUS AND METHOD FOR ELIMINATING X-RAY HAZARDS FROM ELECTRICAL POWER DISTRIBUTION FIELDS

RELATED APPLICATIONS

This application is a continuation-in-part of application Ser. No. 08/264,470, filed Jun. 23, 1994, now abandoned.

BACKGROUND OF THE INVENTION

Field of the Invention

The present invention relates generally to electric power systems and electrostatic and electromagnetic fields associated with high voltage fields; more particularly the invention relates to X-ray radiation in such fields, which is suspect in the etiology of leukemia and other forms of cancer. Health hazards to persons from prolonged exposure to such fields are eliminated by preventive systems and equipment shielding according to the invention.

For several years studies have indicated a strong statistical relation between various childhood cancers and proximity of persons to high tension power lines. A Johns Hopkins University study by S. J. London et al. showed an especially high correlation of cancers to extremely high voltage lines. This study was done by comparing the utility power configurations associated with childhood leukemia with a random sampling of people in the Los Angeles area. It showed two to three times higher occurrence of high power lines in the vicinity of the leukemia patients than for the general public. Other studies have shown an occurrence of breast cancer in male power line workers approximately four times that of the general public.

Because of such studies, power companies have been attempting to ascertain a causal relation between the presence of power lines and the health effects. When the locations studied in the Johns Hopkins University study were checked for electric field strength—i.e., electric and magnetic fields, no correlation was found. Despite the lack of correlation to electric field strength or magnetic field strength, reduction of these fields has been the primary focus of the power companies, for lack of more definitive approaches.

Certain relevant technical aspects are well known in the art. The electric field surrounding a low frequency conductor is approximately perpendicular to the surface of the conductor, as with power lines with corona discharge, and field strength increases near small radii. The equipotential lines are parallel to the conductor and the gradient is perpendicular to the surface in the vicinity of the surface. The wavelength at 60 Hz is sufficiently long with respect to the ionization zone around the conductor to ignore the component in the direction of the conductor. The high electric field provides the energy to accelerate the free electrons to sufficient energy levels to generate X-rays. Soft X-ray levels are only 2–10 times the energy of hard ultraviolet UV, and continue up from there.

Extraneous electric and magnetic fields, which were thought to be a health risk associated with electric power transmission, were avoided in the prior art by using various cable and wiring arrangements, particularly coaxial transmission lines configured so that return current flows in the outer conductors in a bi-polar field-cancelling mode particularly suited to reducing electromagnetic fields. See U.S. Pat. No. 5,218,507 to Ashley, June 1993. However, little attention has been given to X-rays caused by high voltage fields accelerating electrons in coronas. It has been believed that X-rays produced thereby are too soft to be of concern. Recently, there have been statistical studies of correlations of cancer cases with the possibility of X-ray generation in power plants in the vicinity of patients' normal activity. See IEEE Transactions on Broadcasting, Vol. 36, No. 1, March 1990.

BRIEF SUMMARY OF THE INVENTION

Recent research indicates a plausible cause and effect relationship between ionizing radiation and cancer effects.

The electrical and magnetic fields emanating from 60 Hz power lines are nowhere near the energy bands that should produce ionizing radiation. Therefore, high voltage discharge corona effects appear to be a possible cause of X-ray generation.

X-rays for common medical imaging are in the 20 keV (20 kilovolt electron) energy band. The energy released when an electron drifts in vacuum, through a 20,000 volt field, gaining kinetic energy, and impinging on an appropriate target, converts kinetic energy to energetic photons, producing X-rays.

An electron drifting through the same field in air would normally encounter a significant number of air molecules which, because of impacts, would slow the electrons down and prevent sufficient kinetic energy to produce X-rays. As the electric field strength increases, however, the distance necessary to travel to gain the same kinetic energy decreases. This increases the chance that an electron will gain the energy necessary to produce an X-ray when it impacts a target. The target material also affects the generation of X-rays, the efficiency increasing rapidly with increasing atomic number (Z) of the target.

High tension power lines produce extremely high local fields. In places, these are higher than the 20 kilovolts/inch necessary to ionize the air. The corona thus produced is visible as a slight glowing, under proper conditions, or may be heard as crackling on a radio when passing near high tension power lines. A strong discharge may even be audible in the proximity of high tension lines, but not all of this is corona, because some arcing also occurs due to surface contamination of the insulators and faulty insulators.

In accordance with the invention, the electric field strength may be reduced by several means and the target material may be changed. Providing such means and modifications are objects of the instant invention.

A primary object of the invention is to reduce quantity and energy of X-rays generated by high voltage apparatus, by use of low atomic number materials as corona discharge targets. The materials being conductive, insulating, or semiconductive, are used to coat, cover, or sheath high voltage transmission lines and components.

An object of the invention is to use such materials to coat or form the discharge points of high voltage devices, including lightning rods, high voltage contacts, switches and relays, and to use these materials (semiconductive or conductive) to form a coating material capable of covering rough/pointed areas including junctions and hardware to further reduce X-ray generation by reducing arcing. This increases the effective radius of the conductor to reduce the electric field strength and reduce target efficiency. Additionally, shielding may be employed against X-rays emitted from high voltage switches, relays, and interconnects.

Another object of the invention is to provide a method and means for remote sensing of ionizing radiation, including instrumentation to detect and measure, combined with a transponder to report arcing in power equipment, including poles and tower installations. The detection methods include ultrasonics, X-ray, and radio frequency emissions monitoring.

DESCRIPTION OF THE PREFERRED EMBODIMENT

X-rays represent the energy produced by the rapid deceleration of high speed electrons. Electron streams which have been accelerated by strong electric fields surrounding wires and hardware are intensified by sharp points. Sufficiently high fields cause air to break down or ionize, thus causing coronas.

High speed electrons, when slowed by collision with the nuclei of some materials, produce X-rays. High atomic weight nuclei more effectively slow the high speed electrons, and thus produce both more X-rays and higher energy X-rays. Light atomic weight nuclei are less effective in slowing the high speed electrons, requiring multiple collisions, each of which collisions only releases a portion of the total kinetic energy, resulting in lower energy photons, such as light. The percentage of electrons which are able to so interact so as to produce photons is dependent upon the target material. The energy spectrum (if visible light, this would correspond to its color) of the resulting photons is also dependent upon the target material.

Both the quantity of high energy photons and their energy (destructive power) are related to the square of the atomic number of the atoms in the target material into which the electrons are impacting. When the target material is composed of more than one element, the effective atomic number (Z) of the composite is determined by summing up the molar percentage of each element present, multiplied by the atomic number of that element:

$$Z_{effective} = Z_i \times Fraction_i$$

-continued summed for each element present in the target material.

The target does not have to contain metals; it is preferable that it contain only the lighter elements such as hydrogen, carbon, nitrogen, and oxygen. Substituting carbon (Z=6) for steel (Z=26) as the impact target would reduce the X-rays generated by almost a factor of 19. Replacing it by polyisobutylene ($Z_{effective}$=2.67) would reduce the generation by a factor of approximately 95 to 1. The effects would be even greater if the original target were copper (Z=29) or Zinc (Z=30).

X-ray "shielding", however, depends roughly on the mass of the shield encountered. Thus lead, being quite dense, requires only a thin layer to effectively shield an X-ray source, as compared with a lower density material such as iron.

Thus, the "safe" target sheathing material must be low-Z, while any shielding material must be high-Z. Care must be taken that the shielding material does not accidentally become a target, lest it become a producer of X-rays stronger than would exist if no changes had been implemented. The hydrocarbon target material intercepts the majority of the energetic electrons because of the very short mean path length of an electron in a solid.

Figure 1:
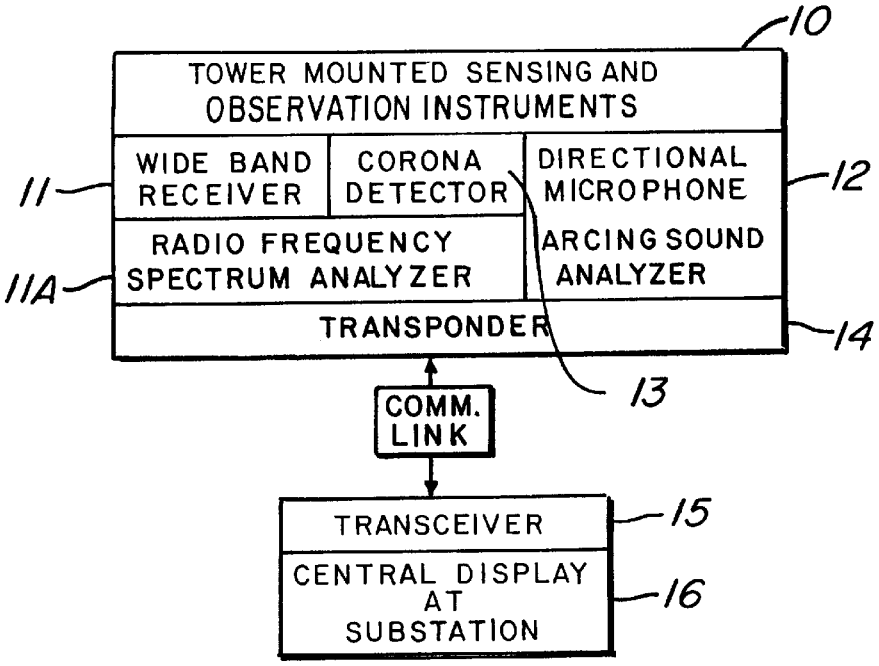
FIG. 1 is a block diagram showing flow of monitoring information in a power station to assure that ionizing radiation does not become hazardous.

Referring to FIG. 1, a block diagram showing the flow of monitoring information in a power station, to assure that ionizing radiation does not become hazardous, the sensing instrumentation preferably includes an energy field detector wide band receiver 11, spectrum analyzer 11A and an audiometer 12 for detecting arcing sounds using directed microphones aimed at critical points on a tower.

Figure 1A:
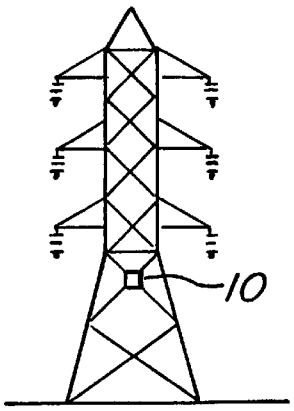
FIG. 1A shows a typical monitoring installation.
Figure 1B:
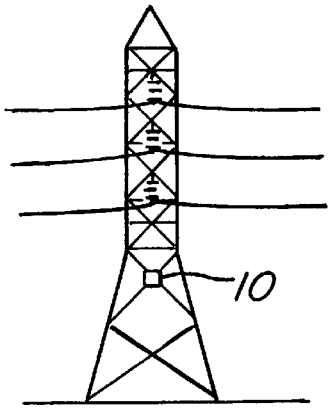
FIG. 1B is a side view of the installation of FIG. 1A.

These instruments are continuously monitored by a transponder 14, which stores the data in memory for recall when interrogated by a transceiver 15; the data is transmitted to, and accumulated and displayed at, a distribution substation 16. The communications link between the tower monitors and the substation may be RF or fiber optic. Ideally, the monitoring instrumentation would be installed in every distribution tower in an area where there is human or animal life within 100 feet of the distribution lines. The preferred mounting position of monitor-transponder 10 relative to a distribution lines tower is shown in FIG. 1A and FIG. 1B.

Monitor transponder 10 at the tower (FIG. 1B) detects time/amplitude noise spectra and/or discharges due to ionization in the vicinity of the tower, these resulting in electrical arcing when the electrical tension between ions of different charge potential becomes sufficiently high to cause corona in a humid atmosphere. Corona discharges which precede and indicate potential X-rays, are detectable by this method and apparatus. The direction and origin of corona in the area of the tower is detectable by aiming a corona detector (an optical instrument) at the source of the corona.

Monitor-transponder 10 is positioned at the center of the tower, between the high voltage conductors and ground, and at the center of any potential X-ray fields which may develop between the high voltage lines and ground, which fields are harmful to biological life.

The hazards to biologic life associated with the X-rays produced due to tower electrical equipment faults, such as arcing or dirty insulators, are reduced by shortening the exposure time, as by prompt notification of the problem to repair personnel. Generally downward directed radiation patterns are of most interest. Corona is the phenomenon of air breaking down when the electric stress at the surface of a conductor exceeds a certain elevated potential value. At higher values, the stress results in a luminous discharge with an arcing sound detectable by a directional microphone and amplifier. Common corona sources are the wires themselves, faulty insulators, and mounting hardware with sharp points.

As is known in the art, strong electric fields may develop between electrically conducting metal elements, such as between a switch or terminal board and any met al at or near ground potential, such as an electrical tower. The potential difference directs the field between the two closest exposed metal elements, so that high tension electrostatic flux fields develop between the two elements, so that high tension electrostatic flux fields develop between the two elements. The direction of such field is between the two exposed elements or points. The electric field charged particles cause X-ray photons to be created when the particles are accelerated between two high and two low potential metallic elements when the field becomes sufficiently strong.

The towers are therefore appropriate places to locate the detectors. The EMI detectors take advantage of the generally isotropic radiation patterns from very small antennae, the individual ionization points. Corona will produce a detectable signal anywhere nearby, as demonstrated by automobile radios near arcing towers.

The corona detection capability of the observation instrument 10 warns of an electrical stress build-up at some component at the tower that could produce X-rays if allowed to become too intense. Notification is thus given as an early warning to the substation to send a crew to correct the problem by the conventional methods of cleaning and/or replacing dirty or defective components.

The X-rays are not in the form of a single beam, but arise from many corona points either at sharp discontinuities, such as wire ends and point-shaped hardware, or along the body of the conductor when the dielectric strength of the air drops below the field strength. A typical design rule is to pick the conductor diameter, or effective diameter when multiple conductors are used, to produce 15 kV/inch. Dry air has a break down voltage of 20 KV/inch, and very damp air has significantly less. High tension power lines may produce coronas in foggy weather as may be viewed on a dark night.

Referring to FIG. 1, the tower-mounted sensing and observation instruments 10 are typically mounted on a platform, which is preferably rotatable for manipulation and aiming of the corona detector for optical observation of the area between the high voltage conductors and the ground about the tower. The directional microphone may also be aimed, in a manner similar to the use of the corona-detector, to detect pre-corona conditions identified by arcing sounds in the audio range. A radio frequency receiver and a spectrum analyzer, locates a source of pre-corona electrical field disturbance and identifies, by the nature of amplitude and noise burst spectra, whether a potential disturbance field is developing. Automatic means may be utilized for spraying low Z material on electrical distribution components where a disturbance field is developing, and operation thereof may be initiated by command via a communications link with a substation.

Repair personnel may be required in some instances to analyze and solve the problem. In either case, the possibility of development of a dangerous X-ray field is being prevented. Audio, visual and radio frequency, as well as remote digital instrument control of observation instruments in the tower, and low Z material spray nozzles, can be controlled from a substation via a communications link to prevent formation of X-ray fields.

Figure 2:
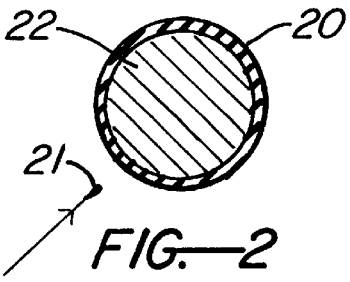
FIG. 2 illustrates a low Z coating on an electrical conductor to prevent the generation of ionizing energy.
Figure 2A:
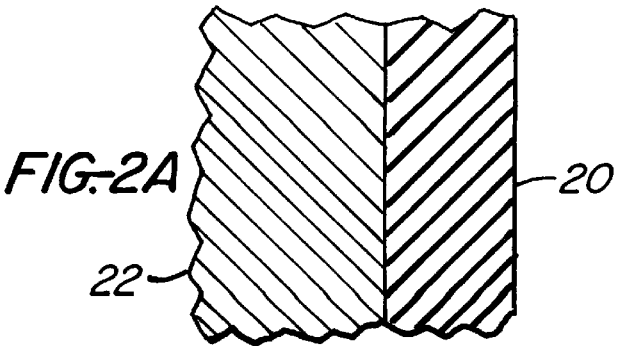
FIG. 2A is an enlarged sectional view of the electrical conductor of FIG. 2.

FIGS. 2 and 2A illustrate the use of low atomic number (Z) coating 20 on an electrical conductor 22 to prevent the generation of high energy photons by the impact of highly accelerated electrons 21 into the conductor. The low Z material 20 produces fewer and lower energy electrons when inserted.

The formulation of a polymer or combination of several isomer molecules, comprising low atomic number (Z) atoms in a plastic product to form a sheath or outer covering on a conductor or cable, substantially eliminates the generation of X-rays in the area about the conductor. A polymer having an amorphous putty-like consistency is another material to be applied, according to the invention, to points where arcing might occur, thus to reduce corona generation about an electrical conductor and provide a soft target for any X-Radiation that might develop from the remaining corona.

Application may be by any appropriate means or method such as spraying, dipping, extruding, chemical grafting and wrapping, as examples. The low Z material application in accordance with the invention is typically of significantly less thickness, weight, thermal resistance, and windage factors than would be needed to provide a full wire-insulator for high tension wires.

The low Z target materials are applied about the outside of any of the elevated potential members, including the wires and connector hardware. The electrons accelerated by the high voltage potentials have a high probability of interacting with the low Z material, rather than penetrating to the contained high Z material. The process of the high speed electron being slowed by interaction with the low Z material produces much less X-ray energy and lower energy X-rays than would be produced by the interaction of the same electrons with high Z material.

Figure 3:
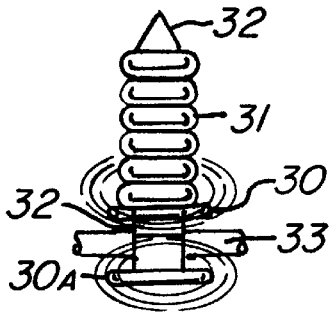
FIG. 3 is an elevational view showing use of low Z target shields on an insulator in a power distribution tower.
Figure 3A:
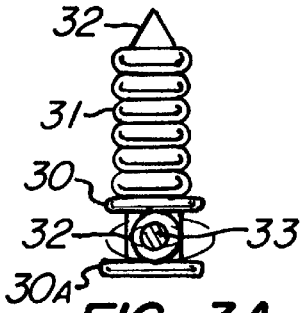
FIG. 3A is a side view of the insulator of FIG. 3.
Figure 4:
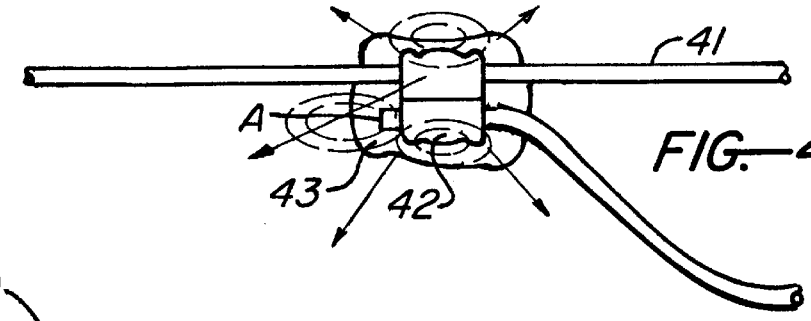
FIG. 4 is an enlarged fragmentary view illustrating the use of low atomic number (Z) conductive putty to reduce corona from sharp points in transmission system wiring to provide a safe arcing target.

More rigid molded elastomeric forms for other applications are shown in FIGS. 3, 3A and 4. The presence of the low Z discharge target provides an inefficient X-ray target rendering the high speed electrons harmless. FIG. 3 shows the use of a low Z shield on an insulator 31 such as is used in power stations. The supporting insulator device 32, through which the high voltage conductor 33 passes, has low Z shield disks 30, 30A on either side of the conductor to provide a safe target for high speed electrons generated by corona. The insulator device 32 is mounted on the distribution tower structure by means well known in the art. FIG. 3A shows the conductor 33 retained in the insulator by well known means, and the low Z shield disks 30, 30A placed on either side of the conductor to dissipate high velocity electrons that could produce X-rays. The disks also reduce the electric field strength to reduce corona generation.

FIG. 4 illustrates the use of low atomic number (Z) polymer putty to reduce corona at points in high tension transmission system wiring, where residual corona and arcing has occurred, to provide an X-ray inhibitor for the residual problem. A conductor 41 for high voltage power, coupled by means of a crimp connector 42 having a tendency to develop an ionizing field at point A, can be electrostatically shielded when the connector 42 is covered with low Z putty coating or low-Z snap covers 43 to reduce the acceleration of electrons necessary to produce X-rays, while also acting as a soft target to further prevent X-ray generation.

The electrostatic field shaping means in accordance with the invention, is the surrounding of sharp points of higher Z material with low Z conductive material. Examples are the wire end A in FIG. 4 surrounded with the conductive putty 43, and the conductive low Z disks 30 and 30A surrounding the mounting hardware 32 in FIGS. 3 and 3A. In both cases, the use of large smooth conductive surfaces reduces the electric field that would otherwise arise proximate to a charged pointed object. This is opposite to the effect of using a sharpened pointed conductor to "draw lightning" by maximizing the field strength at the end of a lightning rod.

The source of free electrons is the discharge plasma from the ionization of air molecules placed in sufficiently strong electrostatic fields. These electrons gain speed as they accelerate through the same electrostatic fields. Sufficiently strong fields allow a percentage of these electrons to reach the required velocities, finally impinging on the conductor. This percentage is a function of the electric field strength and configuration, the dielectric breakdown strength of the surrounding gas which is a function of humidity and pressure, and the gas pressure. All of these factors affect the mean-free-path length before the average electron of the electron field loses much of its energy by impinging on a gas molecule, losing heat and producing low energy photons. Ionizing energy levels are considered by various sources as between 5–10 eV to 100 eV.

Figure 5:
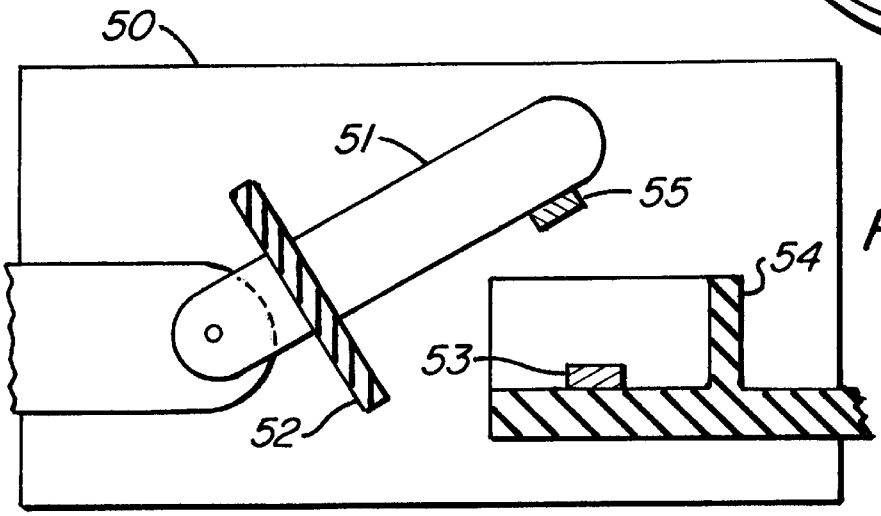
FIG. 5 is an elevational view of a high voltage switch shielded to reduce X-ray emission.

FIG. 5 shows a high voltage switch protected by high Z sheet or cast material to absorb ionizing radiation in specific directions, such as toward the ground, for the protection of persons on the ground in a power plant environment. For example, the contact bar 51 on a high power switch 50 in a power station environment can be fitted with a high Z shield 52, which may be a solid high Z material or powered high Z material in a polymeric base, and the fixed contact 53 surrounded by a high Z ring 54, such that any X-rays formed as the switch opens or closes will not reach personnel.

The source of the X-rays at the switch is this same accelerated electron from the ionization of air by a sufficiently strong electrostatic field. The highly energetic electrons ionizing the air (blue spark) may also generate soft X-rays if they gain enough energy and impinge on a high Z target, such as switch contacts. These arcs are commonly generated, with technicians in close proximity, when the switches are manually operated. The high Z material forms a "shield" that attenuates/absorbs a significant portion of the X-rays generated in the directions that the personnel are located.

The low Z material is used for targets that the high speed electrons are expected to impinge upon, namely the high voltage conductors and attached conductive hardware. As stated earlier high Z material is used as a "shield", such as a lead apron used to protect human body parts not being X-rayed, between the X-ray producing arc at the high Z switch contacts, and the technician operating the switch from below.

As indicated in FIG. 5, high Z shielding is provided at locations of high-power switch contacts for switching inductive loads into and out of high current lines. X-rays are developed when the inductive load is interrupted—i.e., when switched out by opening of a switch, a very high voltage arc can automatically produce X-rays. As a further safety measure, a set of low-Z contacts in parallel with the high-power switch contacts, are utilized to short out the inductive voltage rise upon opening of the switch. Some benefit is derived by the low Z contacts connecting before the switch contacts, and "breaking" after the switch contacts, thus to eliminate formation of X-rays. Low Z material is applied where high speed electron generation is expected—i.e., on the arcing points of the switch. The low Z material serves as an impact target for high speed electrons to reduce conversion efficiency between kinetic energy and X-rays. Low Z coatings can be sprayed on existing high Z shields to reduce the initial formation of X-rays on existing power switches in a power distribution system.

Figure 6:
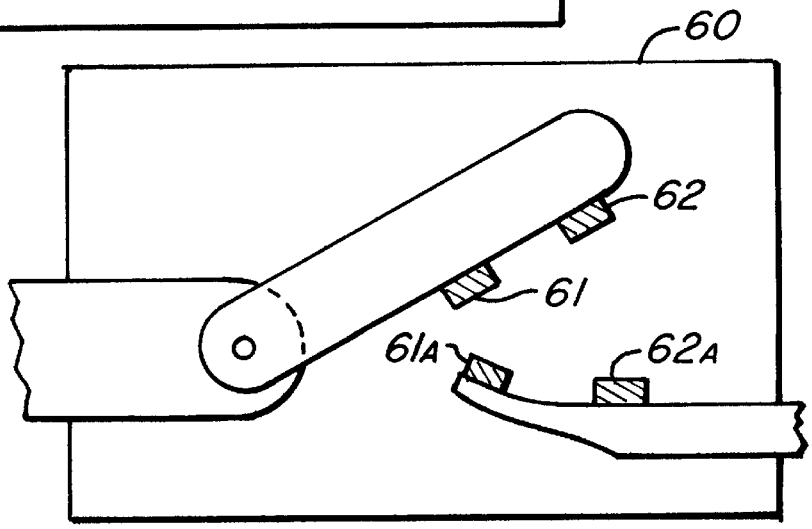
FIG. 6 is an elevational view of a switch having low Z contacts to carry the initial arc upon opening or closing to reduce X-ray generation due to low target efficiency at the are site.

FIG. 6 illustrates an electrical switch 60 having low Z contacts pair 61, 61A for providing the initial contacting and final breaking points for the circuit. Such contacts prevent arcing at the normal electrical contacts 62, 62A, which would be more prone to X-ray generation, particularly when inductive loads are switched out, with their inductive voltage rise and corona at the switch gap. The second set of contacts, 61, 61A is to provide an initial striking contact and a final breaking contact with a material that generates less X-rays when arcing than does the conventional contact.

The shaping of the field is done by elements 52 and 54 (FIG. 5). Similar techniques are the use of spheres in switching stations and Van de Graf generators to minimize ionization; the same effect is used for the opposite purpose in lightning rods and etched microwire cold emitters for solid state tubes.

The composition of materials depends on specific applications, and includes the amorphous putty-like polymer material composed of low Z material, possibly filled with carbon or other low Z materials. Other forms, such as plate or cast forms having low Z X-ray inhibitor therein, are useful for electrical componets.

An advantageous low Z polymer material is polyarylene ether benzimidazole, known as PAEBI, which is quite erosion resistant and resistant to atomic oxygen. It can be extruded into fibers or threads, and woven for certain applications.

A list of such polymers is set forth hereinafter in Table I, and a listing of the Periodic System, Group III or IV atoms possible for use with these polymers, is set forth in Table II.

TABLE I

EXAMPLE OF POLYMERS USABLE AS SAFE TARGET MATERIALS

Vinyl Acetate

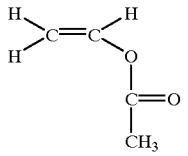

Polyvinyl acetate

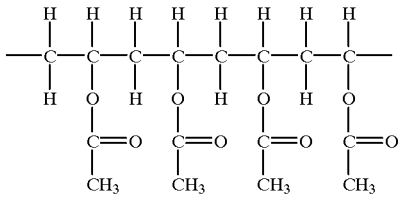

TABLE I-continued

EXAMPLE OF POLYMERS USABLE AS SAFE TARGET MATERIALS

Isobutylene

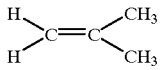

Polyisobutylene

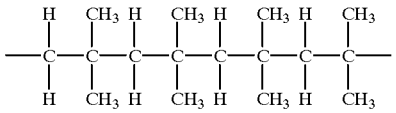

Methyl methacrylate

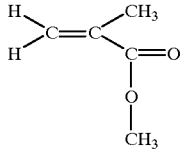

Polymethyl methacrylate

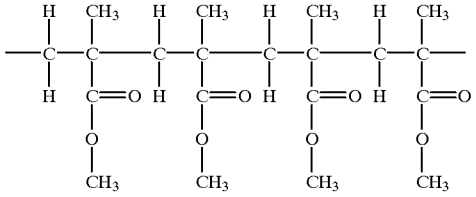

TABLE II

LOW ATOMIC NUMBER ELEMENTS OF THE PERIODIC SYSTEM

| | Atomic Number | n Shells / Subshells | 1 K | 2 L | | 3 M | | | 4 N | | | | 5 O | | | | 6 P | | | | 7 Q | |
|---|---|---|---|---|---|---|---|---|---|---|---|---|---|---|---|---|---|---|---|---|---|---|
| Period | Z | Elements | s | s | p | s | p | d | s | p | d | f | s | p | d | f | p | d | f | s | f | s |
| I | 1 | H | 1 | | | | | | | | | | | | | | | | | | | |
| | 2 | He | 2 | | | | | | | | | | | | | | | | | | | |
| II | 3 | Li | 2 | 1 | | | | | | | | | | | | | | | | | | |
| | 4 | Be | 2 | 2 | | | | | | | | | | | | | | | | | | |
| | 5 | B | 2 | 2 | 1 | | | | | | | | | | | | | | | | | |
| | 8 | C | 2 | 2 | 2 | | | | | | | | | | | | | | | | | |
| | 7 | N | 2 | 2 | 3 | | | | | | | | | | | | | | | | | |
| | 8 | O | 2 | 2 | 4 | | | | | | | | | | | | | | | | | |
| | 9 | F | 2 | 2 | 5 | | | | | | | | | | | | | | | | | |
| | 10 | Ne | 2 | 2 | 6 | | | | | | | | | | | | | | | | | |
| III | 11 | Na | 2 | 2 | 6 | 1 | | | | | | | | | | | | | | | | |
| | 12 | Mg | 2 | 2 | 8 | 2 | | | | | | | | | | | | | | | | |
| | 13 | Al | 2 | 2 | 8 | 2 | 1 | | | | | | | | | | | | | | | |
| | 14 | Si | 2 | 2 | 6 | 2 | 2 | | | | | | | | | | | | | | | |
| | 15 | P | 2 | 2 | 6 | 2 | 3 | | | | | | | | | | | | | | | |
| | 16 | S | 2 | 2 | 8 | 2 | 4 | | | | | | | | | | | | | | | |
| | 17 | Cl | 2 | 2 | 6 | 2 | 5 | | | | | | | | | | | | | | | |
| | 18 | Ar | 2 | 2 | 6 | 2 | 8 | | | | | | | | | | | | | | | |
| IV | 19 | K | 2 | 2 | 6 | 2 | 6 | | 1 | | | | | | | | | | | | | |
| | 20 | Ca | 2 | 2 | 6 | 2 | 6 | | 2 | | | | | | | | | | | | | |
| | 21 | Sc | 2 | 2 | 6 | 2 | 6 | 1 | 2 | | | | | | | | | | | | | |
| | 22 | Ti | 2 | 2 | 6 | 2 | 8 | 2 | 2 | | | | | | | | | | | | | |
| | 23 | V | 2 | 2 | 6 | 2 | 6 | 3 | 2 | | | | | | | | | | | | | |
| | 24 | Cr | 2 | 2 | 8 | 2 | 8 | 5 | 1 | | | | | | | | | | | | | |
| | 25 | Mn | 2 | 2 | 6 | 2 | 8 | 5 | 2 | | | | | | | | | | | | | |
| | 26 | Fe | 2 | 2 | 8 | 2 | 8 | 8 | 2 | | | | | | | | | | | | | |
| | 27 | Co | 2 | 2 | 8 | 2 | 8 | 7 | 2 | | | | | | | | | | | | | |
| | 28 | Ni | 2 | 2 | 8 | 2 | 8 | 8 | 2 | | | | | | | | | | | | | |
| | 29 | Cu | 2 | 2 | 6 | 2 | 6 | 10 | 1 | | | | | | | | | | | | | |
| | 30 | Zn | 2 | 2 | 6 | 2 | 6 | 10 | 2 | | | | | | | | | | | | | |
| | 31 | Ga | 2 | 2 | 8 | 2 | 8 | 10 | 2 | 1 | | | | | | | | | | | | |
| | 32 | Ge | 2 | 2 | 6 | 2 | 8 | 10 | 2 | 2 | | | | | | | | | | | | |
| | 33 | As | 2 | 2 | 6 | 2 | 6 | 10 | 2 | 3 | | | | | | | | | | | | |
| | 34 | Se | 2 | 2 | 6 | 2 | 6 | 10 | 2 | 4 | | | | | | | | | | | | |
| | 35 | Br | 2 | 2 | 8 | 2 | 8 | 10 | 2 | 5 | | | | | | | | | | | | |
| | 36 | Kr | 2 | 2 | 6 | 2 | 8 | 10 | 2 | 6 | | | | | | | | | | | | |

Thus there has been shown and described a novel apparatus and method for eliminating X-ray hazards from electrical power distribution fields which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claim:

1. A system for eliminating X-ray radiation from power distribution tower equipment to ground, said system comprising:

means for monitoring power distribution equipment-generated corona, said monitoring means comprising sensing instrumentation comprising an X-ray energy detector, means for transmitting the status data to a control center for accumulation and analysis, and means for correcting faults that are indicated by the analysis of the data, whereby X-rays produced by tower equipment faults are eliminated by prompt monitoring, reporting and correction of the fault, thus to prevent any damaging X-ray development.

2. A system according to claim 1, wherein:

said sensing instrumentation further comprises an RF spectrum analyzer.

3. A system according to claim 2, wherein:

said sensing instrumentation further comprises a corona detector including a wideband receiver and spectrum analyzer for detecting corona spectra.

4. A system according to claim 1, wherein:

said sensing instrumentation further comprises an audio meter for detecting arcing sounds.

5. A method for eliminating radiation of X-rays from power distribution tower equipment to ground, comprising the steps of:

monitoring the presence of corona generated in the distribution equipment from a control center, and applying low atomic number target materials to elevated-potential equipment for isolating potential X-ray targets to form safe discharge points for corona, whereby electrons accelerated by high voltage potentials have a high probability of interacting with the low Z material rather than penetrating to high Z material.

6. The method according to claim 5, wherein:

said step for applying low atomic number target materials for isolating the potential X-ray generating target is a low Z hydrocarbon based plastic applied by at least one of the steps from the group comprising coating, spraying, dipping, extruding, chemical grafting, and wrapping.

7. A method according to claim 5, wherein:

the applying of low atomic number target materials comprises the applying of a low Z material covering potential electrical discharge points by at least one of the group comprising extrusion, spraying, flame spraying, dipping, plating, sheathing as with woven graphite fibers, chemical grafting, and wrapping.

8. The method according to claim 5, wherein:

said step for isolating potential X-ray targets by X-ray formation-inhibiting material comprises a low-X material covering applied to potential electrical discharge points by at least one step of the group of steps comprising extrusion, spraying, flame spraying, dipping, plating, sheathing as with woven graphite fibers, chemical grafting, and wrapping.

9. A method for eliminating radiation of X-rays by high speed electrons in high voltage fields from electrical equipment, comprising the steps of:

shaping an electrostatic field of electrical potential by rearrangement of the electrical equipment to reduce peak field strength at potential X-ray targets, and applying an X-ray inhibiting material comprising low atomic number atoms onto said potential X-ray targets in the electrical equipment, whereby kinetic energy of the high speed electrons is converted into heat and low energy photons.

10. A method according to claim 9, wherein:

the X-ray inhibiting material comprises polyarylene ether benzimidazole.

11. Apparatus for eliminating radiation of X-rays by high speed electrons in high voltage fields from electrical equipment, said apparatus comprising:

means for shaping a field of the electrical potential of the electrical equipment to reduce peak field strength of potential X-ray targets, and means for isolating the potential X-ray targets by X-ray formation-inhibiting material comprising low atomic number atoms in a material placed between a source of the high speed electrons and the potential X-ray targets in the electrical equipment.

12. Apparatus according to claim 11, wherein:

said X-ray formation-inhibiting material comprises polyarylene ether benzimidazole.

13. Apparatus according to claim 11, wherein:

said means for isolating the potential X-ray target is a substrate configured to enclose a volume radiating the X-rays, and at least one low atomic number element suspended in said substrate.

14. Apparatus according to claim 11, wherein:

said means for isolating the potential X-ray target is an X-ray-safe target material for preventing X-ray radiation from electrical equipment, said target material comprising a substrate such as polymer polyvinyl acetate plastic gum adhesive for conforming and adhering to electrical equipment.

15. Apparatus according to claim 11, wherein:

said means for isolating the potential X-ray target is a low Z putty coating to prevent acceleration of high speed electrons to produce x-rays, while providing a soft target, said low Z putty comprising a polymer such as polyvinyl acetate mixed with powdered carbon.

16. Apparatus according to claim 11, wherein:

said means for isolating the potential X-ray target is a hydrocarbon based plastic material covering for electrical conductors.

17. Apparatus according to claim 11, wherein:

said means for isolating the potential X-ray target comprises low Z material contacts in switches forming the initial and breaking contacts of a switch to reduce X-ray generation present upon opening or closing a switch.

18. Apparatus according to claim 17, wherein:

said contacts are in parallel with conventional contacts to reduce contact arcing, and the low Z material contacts provide an initial striking contact and a final breaking contact with material that generates less X-rays when arcing than the high Z material switch contacts.

* * * * *